US006935539B2

(12) United States Patent
Krieger et al.

(10) Patent No.: US 6,935,539 B2
(45) **Date of Patent: *Aug. 30, 2005**

(54) DEVICE FOR THE METERED DELIVERY OF A VISCOUS LIQUID

(75) Inventors: Matthias Krieger, Cham (CH); Christof Koster, Allenwinden (CH)

(73) Assignee: ESEC Trading SA, Cham (CH)

( * ) Notice: Subject to any disclaimer, the term of this patent is extended or adjusted under 35 U.S.C. 154(b) by 0 days.

This patent is subject to a terminal disclaimer.

(21) Appl. No.: 10/723,685

(22) Filed: Nov. 26, 2003

(65) Prior Publication Data

US 2004/0104252 A1 Jun. 3, 2004

Related U.S. Application Data

(62) Division of application No. 10/184,728, filed on Jun. 27, 2002, now Pat. No. 6,705,845.

(30) Foreign Application Priority Data

Jun. 28, 2001 (CH) ..... 1194/01

(51) Int. Cl.[7] ..... G01F 11/00

(52) U.S. Cl. ..... 222/221; 222/309; 222/361; 417/488

(58) Field of Search ..... 222/221, 309, 222/305–307, 383.1, 372, 366, 354–355, 216–217, 344, 361, 424.5; 417/486–488

(56) References Cited

U.S. PATENT DOCUMENTS

| | | | | |
|---|---|---|---|---|
| 2,169,807 A | | 8/1939 | Lyon | |
| 2,529,457 A | | 11/1950 | Nilsson | |
| 3,302,578 A | * | 2/1967 | Anderson | 417/488 |
| 3,471,079 A | * | 10/1969 | Myers | 417/397 |
| 3,695,788 A | | 10/1972 | Loomans | 417/488 |
| 3,802,608 A | * | 4/1974 | Gullett | 222/309 |
| 3,975,960 A | * | 8/1976 | Croslin | 73/864.18 |
| 4,688,609 A | * | 8/1987 | Diaz | 141/82 |
| 4,941,808 A | * | 7/1990 | Qureshi et al. | 417/415 |
| 5,366,904 A | * | 11/1994 | Qureshi et al. | 436/180 |
| 5,467,899 A | * | 11/1995 | Miller | 222/309 |
| 5,580,227 A | | 12/1996 | Rappenhoner | 418/23 |
| 5,639,220 A | | 6/1997 | Hayakawa | 417/53 |
| 6,079,960 A | | 6/2000 | Funatsu et al. | 417/488 |
| 6,332,924 B1 | * | 12/2001 | Shim et al. | 118/684 |
| 6,499,972 B2 | | 12/2002 | Yatsuzuka et al. | 417/417 |
| 6,705,845 B2 | * | 3/2004 | Krieger et al. | 417/488 |

FOREIGN PATENT DOCUMENTS

| | | | |
|---|---|---|---|
| FR | 2 617 541 | 1/1989 | F04B/13/00 |
| SG | 9903371-4 | 7/1999 | B01J/4/02 |

OTHER PUBLICATIONS

European Search Report, for Inernational Application No. EP 02 01 3231, date mailed Oct. 2, 2003.

* cited by examiner

*Primary Examiner*—Frederick Nicolas
(74) *Attorney, Agent, or Firm*—Thelen Reid & Priest; David B. Ritchie

(57) ABSTRACT

A device for the metered delivery of a viscous liquid has a pump body with a drill hole accommodating two pistons which connects a first chamber serving as an intake chamber and a second chamber serving as a discharge chamber. Two swivel arms driven by two cam discs are foreseen as the drive mechanism for the back and forth movement of the two pistons.

Figure 1:
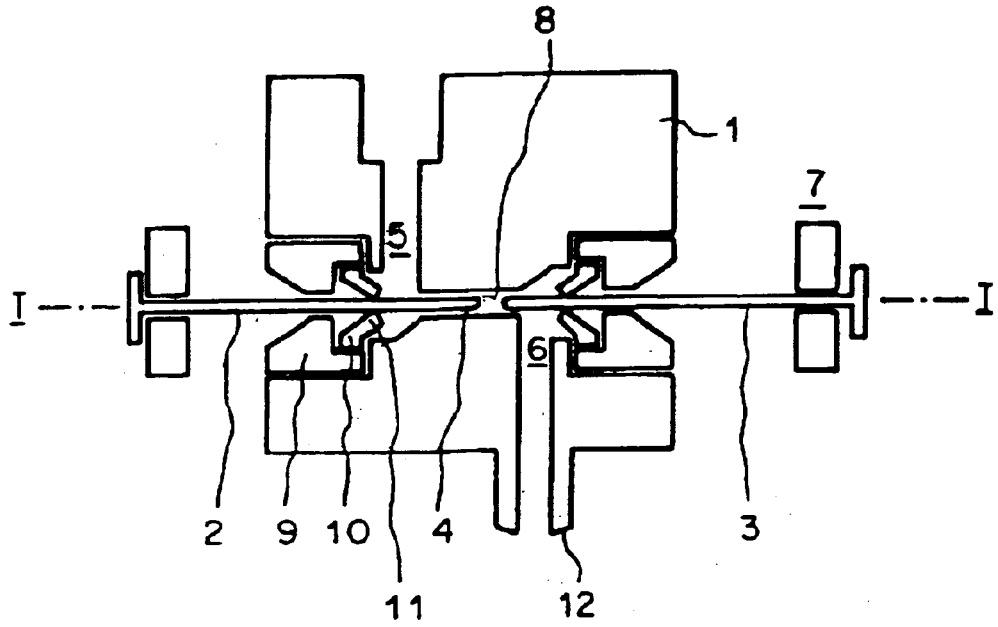

For the metered delivery of an adhesive which contains flakes of silver the drill hole is designed such that it serves for guiding the pistons as well as for sealing the pump path.

20 Claims, 5 Drawing Sheets

DEVICE FOR THE METERED DELIVERY OF A VISCOUS LIQUID

CROSS-REFERENCE TO RELATED APPLICATION

This application is a divisional of U.S. patent application Ser. No. 10/184,728, entitled "Device for the Metered Delivery of a Viscous Liquid", filed on Jun. 27, 2002, now U.S. Pat. No. 6,705,845 in the name of the same inventors and commonly owned herewith.

PRIORITY CLAIM

The present application claims priority under 35 U.S.C §119 based upon Swiss Patent Application 2001 1194/01 No. filed Jun. 28, 2001.

FIELD OF THE INVENTION

The invention concerns a device for the metered delivery of a viscous liquid.

BACKGROUND OF THE INVENTION

A device for the metered delivery of a viscous liquid is known from the Singapore patent application SG 0074739. This device comprises a pump body with a drill hole which connects an intake chamber and a discharge chamber. In this drill hole, two pistons are moved back and forth between the intake chamber and the discharge chamber. A slot of variable width is formed between the faces of the two pistons so that the liquid in the intake chamber fills the slot and is pressed out of the slot into the discharge chamber. To guide the pistons, guide rails are present which are guided in further, parallel running drill holes.

This device has two disadvantages. When used for applying adhesive, it can happen that flakes of silver contained in the adhesive make their way to the outside of the pump body and from there into the drill holes which accommodate the guide rails which leads to the guide rails sticking. Furthermore, the friction of the guide rails in the drill holes is too great.

The object of the invention is to rectify the above mentioned shortcomings.

BRIEF DESCRIPTION OF THE INVENTION

The invention shows on the one hand an improved drive mechanism as well as certain constructive measures which prevent the drive mechanism from sticking and, on the other hand, a pump body which is particularly suitable for the metered delivery of adhesives which contain flakes of silver. This pump body distinguishes itself in that the drill hole which connects the intake chamber with the discharge chamber is extended whereby the two pistons which are moved back and forth in the drill hole form a slot seal at the ends of the drill hole. In order that the slot seal is sufficiently tight, the piston and the pump body or a sleeve incorporated into the pump body which contains the drill hole are, on the one hand, paired with suitable materials and, on the other hand, are manufactured with the highest precision.

In the following, an embodiment of the invention is explained in more detail based on the drawing.

BRIEF DESCRIPTION OF THE DRAWING FIGURES

Figure 4:
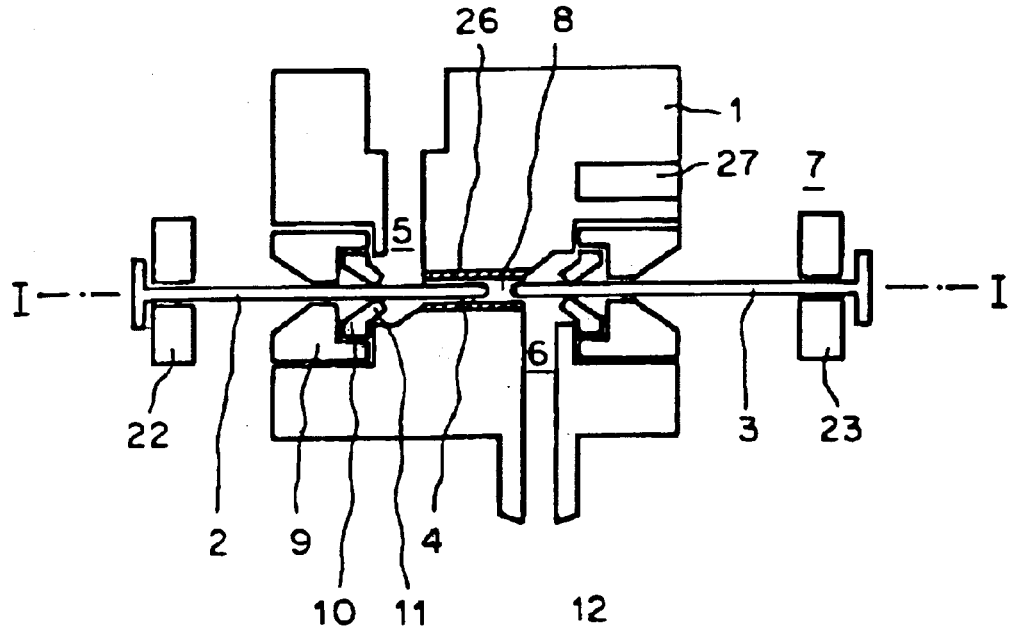
Figure 2:
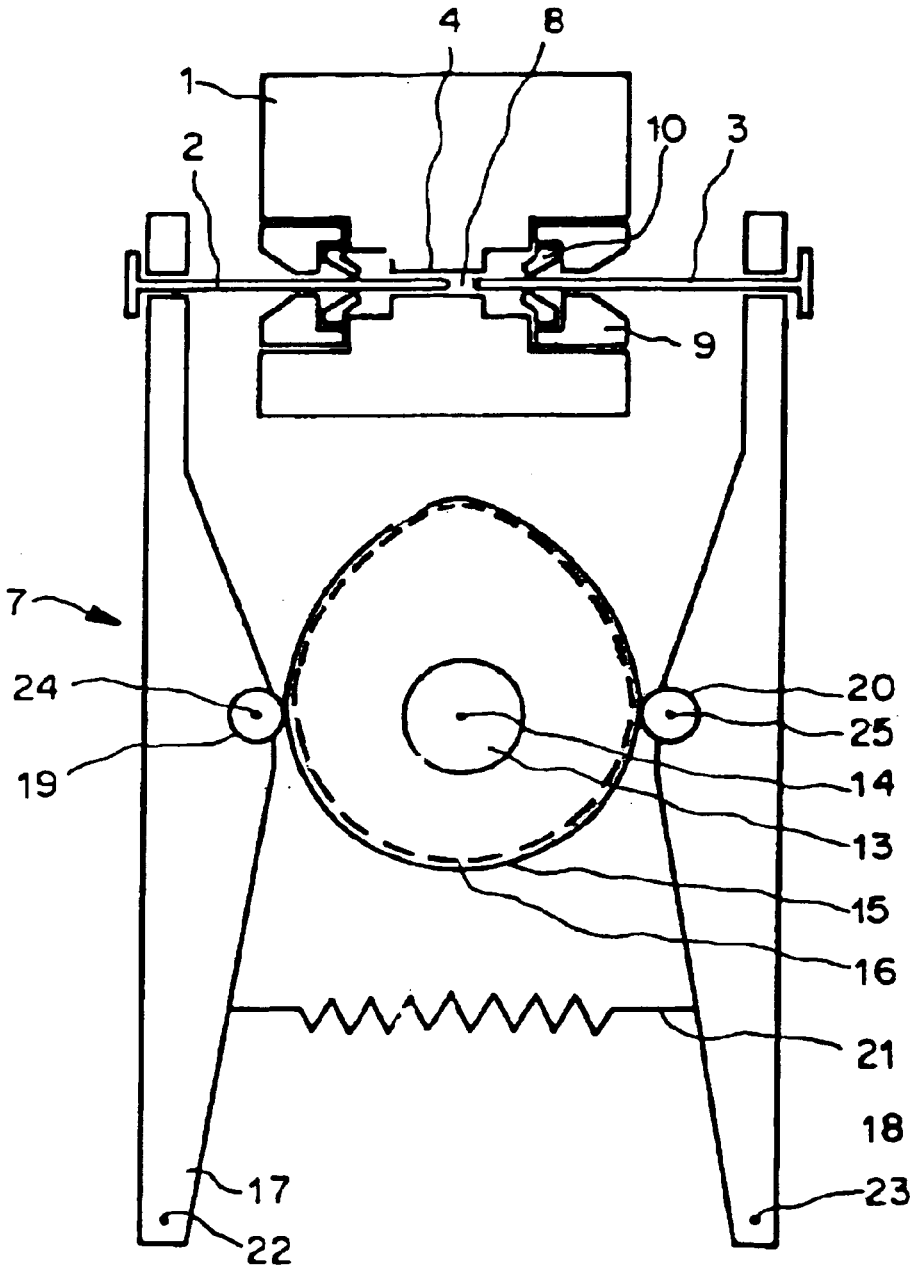
Figure 5:
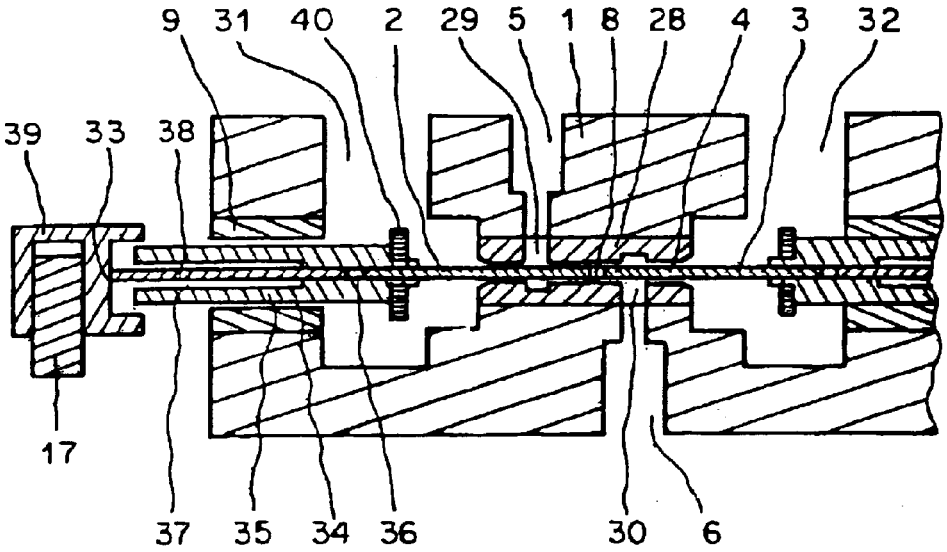
Figure 6:
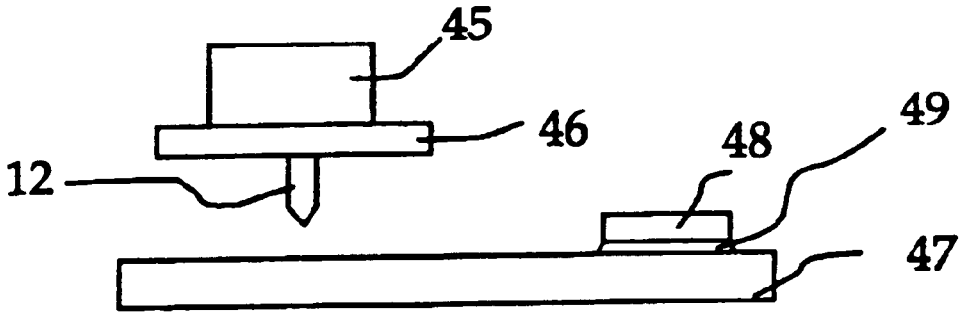

FIG. 1 shows a cross-section of a device for the metered delivery of a viscous liquid, FIG. 2 shows a section of the metering device along the line I—I of FIG. 1, FIG. 3A–F shows the metering device in various working phases, FIG. 4 shows a further example of the metering device, and FIG. 5 shows a pump body suitable for adhesives silver flakes, FIG. 6 shows the inventive use of the device of the invention on a writing head for the application of adhesive onto a substrate to be equipped with a semiconductor chip.

DESCRIPTION OF THE INVENTION

FIG. 1 shows a device for the metered delivery of a viscous liquid which is suitable for the metering and delivery of very small amounts of adhesive. Basically, the device consists of a pump body 1 and a drill hole 4 which accommodates two pistons 2 and 3 and which connects a first chamber 5 serving as an intake chamber and a second chamber 6 serving as a discharge chamber, and a drive mechanism 7 for the back and forth movement of the two pistons 2 and 3 between the intake chamber 5 and the discharge chamber 6. The drive mechanism 7 is formed in such a way that the width of a slot 8 formed between the opposite faces of the pistons 2 and 3 varies in a specific way during the back and forth movement of the pistons 2, 3.

The pump body 1 has a recess on each side of the drill hole 4 into which a bearing block 9 is inserted. The bearing blocks 9 comprise a drill hole running concentrically to the drill hole 4 which is widened in a funnel-shape towards the outside. In addition, the bearing blocks 9 accommodate an elastically deformable sealing element 10. The sealing element 10 comprises a sealing lip 11 with a central opening for accommodating the piston 2 or 3. The opening of the sealing lip 11 is smaller than the diameter of the pistons 2 and 3. The sealing lip 11 therefore surrounds the corresponding piston 2 or 3 with a tight fit. With the back and forth movement of the corresponding piston 2 or 3 the sealing lip 11 is elastically deformed.

With the example shown, the pump body 1 is already prepared for use as a writing head in that the chamber 6 serving as the discharge is formed as a writing nozzle 12 or for equipping with a writing nozzle. The viscous liquid is fed to the intake chamber from a not presented liquid reservoir through a hose.

FIG. 6 illustrates the use of the device 45 on a writing head 46 for the application of adhesive onto a substrate 47 is to be equipped with a semiconductor chip. The adhesive is supplied through the writing nozzle 12. A semiconductor chip 48 mounted on substrate 47 by a portion of adhesive 49 shown on the right hand side.

The drive mechanism 7 will now be explained in more detail based on FIG. 2 which shows a section of the metering device at the level of line I—I of FIG. 1. The drive mechanism 7 comprises a motor 13, onto the shaft 14 of which two cam discs 15 and 16 are attached, two swivel arms 17 and 18 each with a ball bearing 19 and 20 and a spring 21. One end of the first swivel arm 17 can swivel on an axis 22 running vertically to the plane of the drawing while the piston 2 is detachably secured to the other end of the first swivel arm 17. Likewise, one end of the second swivel arm 18 can swivel on an axis 23 running parallel to the first axis 22 while the other piston 3 is detachably secured to the other end of the second swivel arm 18. The pistons 2, 3 are preferably screwed into the corresponding swivel arm 17, 18. The ball bearing 19 of the first swivel arm 17 consists of a disc which rotates on an axis 24 and rests on the first cam disc 15. The ball bearing 20 of the second swivel arm 18 comprises a disc which rotates on an axis 25 and rests on the second cam disc 16. The spring 21 connects the two swivel arms 17 and 18 and ensures that the ball bearings 19 and 20 remain in permanent contact with the corresponding cam disc 15 or 16.

One turn of the motor or the cam discs 15, 16 secured to its shaft 14, causes a back and forth movement of the pistons 2 and 3. The radius changes of the cam discs 15, 16 are transformed into a swivel movement of the swivel arms 17, 18 and therefore into the back and forth movement of the pistons 2 and 3. Because the radius changes of the cam discs 15, 16 are different, the back and forth movement of the pistons 2 and 3 is superimposed by a modulation in the width of the slot 8 formed between them.

The bearing blocks 9 are preferably comprised of an abrasion resistant plastic while the pistons 2 and 3 are preferably made of steel. The drill hole of the bearing block 9 takes over the guiding of the corresponding piston 2 or 3. Because the swivel arms 17 and 18 carry out a turning movement around the axis 22 or 23, the tips of the pistons 2 and 3 would move on a circular path if they were not prevented from doing so. The drill hole of the bearing block 9 has the task of guiding the corresponding piston in such a way that the tip of the piston moves in the drill hole 4 along as straight a path as possible. The guiding and bearing of the piston in the drill hole of the bearing block 9 leads to the piston only being elastically deformed in the area between the swivel arm and the drill hole of the bearing block 9 while the piston remains straight in the area between the drill hole of the bearing block 9 and within the drill hole 4.

In order that the device can be used as a writing head for the application of adhesive onto a substrate which is to be equipped with a semiconductor chip, its dimensions must be as small as possible because, during writing, the writing head is subjected to great accelerations. Consequently, the ball bearings 19 and 20 must be light and the load on the ball bearings 19 and 20 caused by the swivel arms 17 and 18 must not exceed certain limits otherwise the ball bearings 19 and 20 will be damaged. The force with which the spring 21 pulls the swivel arms 17 and 18 together must, on the one hand be great enough so that the ball bearings never loose contact with the corresponding cam discs; on the other hand, it is set an upper limit because of the loading capacity of the ball bearings 19, 20 which must not be exceeded. During operation, the motor turns at high speed in the range of 1000 to 10,000 revolutions per minute. The centrifugal forces exerted on the swivel arms 17, 18 are proportional to the mass of the swivel arms 17, 18. The force exerted by the spring 21 must be greater than the maximum centrifugal force so that the swivel arms 17, 18 do not lift off the cam discs 15 and 16. It has become apparent that a material must be used for the swivel arms 17, 18 the relative density of which is less than the relative density of aluminium. Therefore, the two swivel arms 17 and 18 are preferably made of plastic. Furthermore, the plastic must demonstrate great rigidity so that the swivel arms 17 and 18 do not wobble which would lead to an unintentional modulation of the width of the slot 8 between the pistons 2 and 3.

Figure 3A:
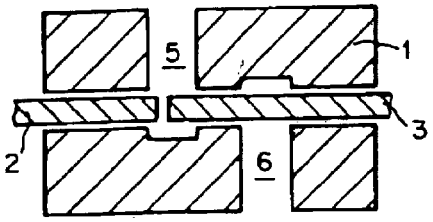
Figure 3B:
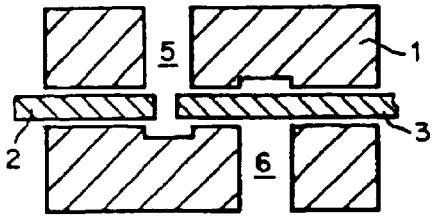
Figure 3C:
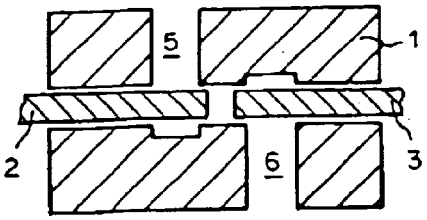
Figure 3D:
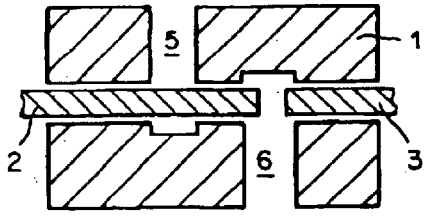
Figure 3E:
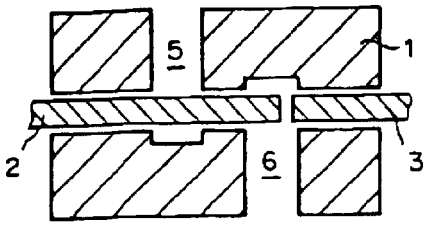
Figure 3F:
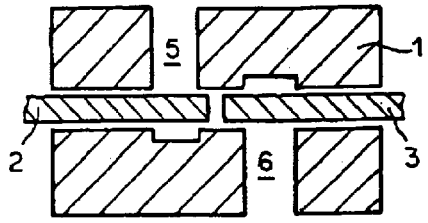

FIGS. 3A–F show schematically the relative position of the pistons 2 and 3 during one single rotation of the cam discs 15 and 16 in six different relative positions. At the start, the faces of the pistons 2 and 3 are located within the first chamber 5 whereby a small slot is formed between the two end faces of the pistons 2 and 3 (FIG. 3A). First of all, only the piston 3 now moves so that the slot between the two pistons 2 and 3 enlarges. The enlarged slot immediately fills with liquid (FIG. 3B). Subsequently, the two pistons 2 and 3 move together from the first chamber 5 to the second chamber 6 whereby the width of the slot remains constant (FIG. 3C). In this way, a predefined amount of liquid is transported from chamber 5 to chamber 6. After that, the piston 3 remains stationary (FIG. 3D), while the piston 2 is moved further until the slot between the end faces of the two pistons 2 and 3 again achieves the original, small width (FIG. 3E). During this phase, the amount of liquid which is located in the slot between the pistons 2 and 3 is pressed into the chamber 6. Subsequently, the two pistons 2 and 3 are moved back together whereby the slot between their faces maintains the small width (FIG. 3F) until, after one complete rotation of the motor, they are again located in the starting position (FIG. 3A). During a back and forth movement of the pistons 2 and 3 therefore, the distance between their end faces varies whereby the distance on the way forth is greater than on the way back so that a predefined liquid volume is conveyed from the first chamber 5 to the second chamber 6.

It has proved to be of advantage when the distance between the two pistons 2 and 3 is always greater than zero. Typically, the width of the slot between the pistons 2 and 3 varies between 0.4 mm and 0.7 mm. The filling of the slot 8 with adhesive in the intake chamber then takes place more quickly. Furthermore, the device is more robust towards assembly tolerances.

The device in accordance with the invention is suitable for the metered delivery of numerous liquids. There are adhesives with which, as a result of the shearing of the liquid in the drill hole 4 in the pump body 1, friction occurring at high speeds of the motor causes heating of the pump body 1. Three measures are now foreseen which can be used individually or in combination in order to keep the heating of the pump body 1 within limits:

1. In order to reduce the friction, the diameter of the drill hole 4 can be selected larger than the diameter of the pistons 2 and 3. This does in fact lead to a certain leakage rate through the drill hole 4 which connects the first chamber 5 serving as an intake chamber and the second chamber 6 serving as a discharge chamber. A leak can however be accepted when the leakage rate is small in comparison with the rate of liquid pumped. When the diameter of the drill hole 4 is only slightly larger than the diameter of the pistons 2 and 3 and when the pressure predominating in the first chamber is not too great, then, in many cases, the viscosity of the liquid nevertheless prevents leakage. In addition, during the pauses in which there is no liquid to meter and discharge, either the pressure applied to the first chamber can be reduced or the motor can be run in the opposite direction at a comparatively slower speed adapted to the leakage rate. It has become apparent that the diameter of the drill hole 4 should preferably be at least 20 micrometers larger than the diameter of the first piston 2.

2. The pump body 1 can be manufactured from a good thermal conducting material, for example metal, because such a pump body can better conduct the heat produced in the drill hole 4 to its outer surface and convey it to the atmosphere than a pump body made of plastic. If the pump body 1 is made of metal, then the drill hole 4 of the pump body 1, as is shown in FIG. 4, is lined with plastic in that a pipe 26 made of plastic for example is inserted into the drill hole in order to maintain low wear of the steel pistons 2 and 3.

3. A cooling element 27 for the active cooling of the pump body (1), eg, a Peltier element, can be arranged on the pump body 1. The cooling element 27 is preferably arranged as close as possible to the drill hole 4 where the heat is created.

The described metering device is suitable for all types of adhesive with the exception of adhesives which contain flakes of silver as filling material. The silver flakes have namely the undesirable characteristic of settling on the pistons 2 and 3. This leads to the slow but continuous abrasion of the sealing lips and their gradual destruction. The pump body 1 described below based on FIG. 5 is suitable for adhesives of this type.

FIG. 5 shows a cross-section of the pump body 1, whereby the right-hand part of the figure is cut off. The pump body 1 has a sleeve 28 which is equipped in longitudinal direction with the drill hole 4 which accommodates the two pistons 2 and 3. The drill hole 4 is widened at both ends so that the pistons 2 and 3 can be easily inserted when the pump is constructed. The sleeve 28 contains two further drill holes 29 and 30 running orthogonally to drill hole 4 one end of each opening into the drill hole 4 and the other end opening into the intake chamber 5 or discharge chamber 6 in the pump body 1. The drill hole 4 therefore extends laterally beyond the intake chamber 5 as well as the discharge chamber 6. The drill hole 4 takes over the bearing of the two pistons 2 and 3 as well as the sealing of the pump path. With this embodiment, the drill hole 4 therefore also takes over the function of the sealing lips 11 of the first embodiment. The drill hole 4 and the corresponding piston 2 or 3 form a slot seal. In order to achieve a sufficiently tight seal, the sleeve 28 and the pistons 2 and 3 must be manufactured with high precision and from materials which suit each other. Good results were achieved when the pistons 2 and 3 and the sleeve 28 are each made of a hard metal or when the pistons 2 and 3 are made of tool steel and the sleeve 28 is made of ceramic. The radius of the drill hole 4 is manufactured with a value of 201 $\mu$m±0.5 $\mu$m, and the radius of the pistons 2 and 3 with a value of 200 $\mu$m±0.15 $\mu$m. Ideally, this results in a slot width of 1 $\mu$m. Suitable hard metals are, for example, WC (tungsten carbide), TiC (titanium carbide), TaC (tantalum carbide) or mixtures of these carbides which, mixed with Co (cobalt), have been sintered. Ceramic materials have the advantage of a higher abrasion resistance but the disadvantage of a lower thermal conductivity than hard metals.

The diameter of the drill holes 29 and 30 is preferably larger than the diameter of drill hole 4 so that the adhesive can be pressed as quickly as possible into or out of the slot 8 formed between the opposing faces of the pistons 2 and 3.

The pump body 1 has two vertically running blind holes 31 and 32 which are arranged on both sides of the sleeve 28 and communicate with the drill hole 4. These blind holes 31 and 32 serve to take up adhesive emerging in the course of time from the drill hole 4 as a result of possible insufficient sealing effect of the slot seal. If the pump is cleaned at regular intervals, then the adhesive can be removed from the blind holes 31 and 32 before other parts of the pump are contaminated.

The drive mechanism 7 described based on FIG. 2, has the peculiarity that the point 33, where the rotational movement of the first swivel arm 17 is converted into the back and forth movement of the piston 2, moves back and forth on a circular path. The same is valid for the point on the second swivel arm 18 where the rotational movement of the second swivel arm 18 is converted into the back and forth movement of the piston 3. In order to keep the abrasion of the pistons 2 and 3 on the sleeve 28 as low as possible, these fixing points and with them the pistons 2 and 3 should not move back and forth on the circular path but along a straight line. In order to achieve a straight line movement of the pistons 2 and 3, a decoupling mechanism is foreseen which is constructed the same for pistons 2 and 3 but which is only described in more detail based on piston 2. The pump body 1 or a separate bearing block 9 fitted into the pump body 1 as with the first embodiment has a drill hole 34 running concentrically to the drill hole 4 within which a sleeve 35 is movably supported. The drill hole 34 forms a bearing for the sleeve 35. The sleeve 35 has a longitudinal drill hole 36 one end of which accommodates one end of the piston 2. The longitudinal drill hole 36 runs coaxially to the drill hole 4. The longitudinal drill hole 36 is widened on the side facing away from the piston 2 and forms an extended cavity 37. A pin 38 connects the swivel arm 17 with the sleeve 35. On the one hand, the pin 38 is detachably fixed to the swivel arm 17 via a coupling element 39 and, on the other hand, is rigidly fixed in the longitudinal drill hole 36 of the sleeve 35. When the end of the swivel arm 17 moves back and forth on the circular path, then the sleeve 35 also moves back and forth and with it the piston 2. The bearing block 9 now ensures that the sleeve 35 moves along a straight line. In doing so, the pin 38 is bent on the path from the swivel arm 17 up to the longitudinal drill hole 36 of the sleeve 35. The piston 2, however, is not loaded by means of the circular path movement of the swivel arm 17 as its movement is guided by means of the sleeve 35 supported in the bearing block 9.

The coupling element 39 has a protruding edge surrounding the end of the sleeve 35 whereby the edge of the coupling element 39 and the sleeve 35 are separated by a small slot. This construction guarantees that the pin 38 cannot be damaged during pump maintenance as the edge of the coupling element 39 comes to a stop on the sleeve 35 before the pin 38 can be bent too strongly.

Preferably, the sleeve 35 has a thread on its front end onto which a nut 40 inserted through the blind hole 31 is screwed. In this way, the piston 2 is prevented from falling out during maintenance to the pump body 1.

A particular advantage of this pump body 1 is that the tips of the pistons 2 and 3 always remain inside the drill hole 4.

With this embodiment, the pump body 1, the sleeve 28 and the two bearing blocks 9 are separate parts which can be manufactured separately. This design offers the advantage that the materials used for the sleeve 28 and the two pistons 2 and 3 can be optimally matched. Likewise, the materials used for the bearing blocks 9 and the sleeve 35 can be optimally matched. Furthermore, the material for the pump body 1 can be selected so that the pump body 1 demonstrates optimum characteristics, for example a high thermal conductivity, or can be easily manufactured. However, it is also possible to manufacture the pump body 1 and the sleeve 28 from one piece of material. Likewise, it is possible to manufacture the pump body 1 and the bearing blocks 9 from one piece of material. Another version consists in manufacturing the sleeves 28 and 35 from the same material and therefore as one piece.

With the embodiment in accordance with FIG. 5, another drive mechanism can also be used for the back and forth movement of the pistons 2 and 3, for example the drive mechanism described in the Singapore patent application SG 0074739. The pistons 2 and 3 can also be driven directly, ie, the bearing blocks 9 and the sleeve 35 can be omitted as long as the drive takes place in the direction of the axis defined by means of the drill hole 4.

What is claimed is:

1. A device for the metered delivery of a viscous liquid, comprising:

a first and second piston consisting of a selected one of hard metal or tool steel, a pump body comprising a first sleeve consisting of a selected one of hard metal or ceramic and having a first drill hole accommodating the pistons as well as two further drill holes which run orthogonally to the first drill hole and one end of which opens out into the first drill hole and the other end of which opens out into an intake chamber or a discharge chamber in the pump body, wherein the first drill hole and the first and second piston each form a slot seal and wherein the pistons each stick out at a respective end of the first drill hole, and a drive mechanism for moving the pistons back and forth such that a width of a slit formed between the pistons varies during the back and forth movement.

2. The device according to claim 1, the pump body further including two blind holes, wherein the ends of the first drill hole of the first sleeve open out into the blind holes.

3. The device according to claim 1, wherein the first sleeve and the pump body consist of one piece of material.

4. The device according to claim 2, wherein the first sleeve and the pump body consist of one piece of material.

5. The device according to claim 1, the pump body further comprising two bearings in each of which a second or third sleeve, respectively, is movably supported, whereby an end of the first piston is secured in the second sleeve and an end of the second piston is secured in the third sleeve, the second and third sleeve forming part of the drive mechanism.

6. The device according to claim 2, the pump body further comprising two bearings in each of which a second or third sleeve, respectively, is movably supported, whereby an end of the first piston is secured in the second sleeve and an end of the second piston is secured in the third sleeve, the second and third sleeve forming part of the drive mechanism.

7. The device according to claim 1, wherein a radius of the first drill hole is manufactured within a tolerance of ±0.5 $\mu$m and a radius of the pistons with a tolerance of ±0.15 $\mu$m.

8. The device according to claim 2, wherein a radius of the first drill hole is manufactured within a tolerance of ±0.5 $\mu$m and a radius of the pistons with a tolerance of ±0.15 $\mu$m.

9. The device according to claim 3, wherein a radius of the first drill hole is manufactured within a tolerance of ±0.5 $\mu$m and a radius of the pistons with a tolerance of ±0.15 $\mu$m.

10. The device according to claim 4, wherein a radius of the first drill hole is manufactured within a tolerance of ±0.5 $\mu$m and a radius of the pistons with a tolerance of ±0.15 $\mu$m.

11. The device according to claim 5, wherein a radius of the first drill hole is manufactured within a tolerance of ±0.5 $\mu$m and a radius of the pistons with a tolerance of ±0.15 $\mu$m.

12. Use of the device according to claim 1 on a writing head for the application of adhesive onto a substrate which is to be equipped with a semiconductor chip.

13. Use of the device according to claim 2 on a writing head for the application of adhesive onto a substrate which is to be equipped with a semiconductor chip.

14. Use of the device according to claim 3 on a writing head for the application of adhesive onto a substrate which is to be equipped with a semiconductor chip.

15. Use of the device according to claim 4 on a writing head for the application of adhesive onto a substrate which is to be equipped with a semiconductor chip.

16. Use of the device according to claim 5 on a writing head for the application of adhesive onto a substrate which is to be equipped with a semiconductor chip.

17. Use of the device according to claim 6 on a writing head for the application of adhesive onto a substrate which is to be equipped with a semiconductor chip.

18. Use of the device according to claim 7 on a writing head for the application of adhesive onto a substrate which is to be equipped with a semiconductor chip.

19. Use of the device according to claim 8 on a writing head for the application of adhesive onto a substrate which is to be equipped with a semiconductor chip.

20. Use of the device according to claim 9 on a writing head for the application of adhesive onto a substrate which is to be equipped with a semiconductor chip.

* * * * *